United States Patent [19]

DeBlock et al.

[11] 4,162,984

[45] Jul. 31, 1979

[54] TEXTILE TREATMENT COMPOSITIONS

[75] Inventors: Frans DeBlock, Merchtem; Pierre C. E. Goffinet; Fleming Sorensen, both of Brussels, all of Belgium

[73] Assignee: The Procter & Gamble Company, Cincinnati, Ohio

[21] Appl. No.: 910,914

[22] Filed: May 30, 1978

[30] Foreign Application Priority Data

May 30, 1977 [GB] United Kingdom ..... 22740/77

[51] Int. Cl.[2] ..... D06M 13/34

[52] U.S. Cl. ..... 252/8.8; 8/115.6; 252/8.6

[58] Field of Search ..... 252/8.8, 8.6; 8/115.6

[56] References Cited

U.S. PATENT DOCUMENTS

| | | | |
|---|---|---|---|
| 3,630,929 | 12/1971 | van Dijk | 252/136 |
| 3,954,634 | 5/1976 | Gloss | 252/8.8 |
| 3,959,155 | 5/1976 | Montgomery et al. | 252/8.8 |

*Primary Examiner*—William E. Schulz

[57] ABSTRACT

A textile treatment composition in emulsion form which is based on a mixture of cationic and nonionic softener includes an aromatic mono- or di-carboxylic acid as a viscosity modifier. The presence of a carboxylic acid such as benzoic acid or salicylic acid in emulsified mixtures of a di-higher alkyl quaternary ammonium salt and a nonionic material having at least one higher alkyl chain gives a significant increase in viscosity.

9 Claims, No Drawings

TEXTILE TREATMENT COMPOSITIONS

This invention relates to fabric softening compositions and, in particular, to compositions in the form of an aqueous emulsion or dispersion and based on mixtures of cationic and nonionic fabric softeners.

Conventional rinse-added fabric softeners contain fabric softening agents which are cationic materials such as distearyl dimethyl ammonium chloride. The positive charge on the softening compound encourages its deposition onto the fabric substrate, the surface of which is usually negatively charged.

However, although the above-mentioned cationic compounds are highly effective softeners when applied in a rinse solution, there are certain disadvantages associated with their use. For example, the cationic compounds having long alkyl chains are very sensitive to carry over of anionic detergent into the rinse. Thus, carry over of anionic detergent tends to neutralize the softening effect because the anionic-cationic complex tends to precipitate out of solution. Also, certain cationic surfactant compounds are expensive and in short supply and it is therefore desirable, for commercial reasons, to provide softening compositions having a reduced amount of cationic surfactant compound. Furthermore, softening compositions which comprise predominantly long chain cationic compounds have the disadvantage that the treated fabrics tend to become overloaded with softener and become discoloured, greasy or undesirably non-absorbent.

The German patent application DOS No. 2,631,114 describes useful fabric softening compositions based on mixtures of cationic and nonionic materials. While these compositions overcome the problems referred to above, they suffer from the disadvantage that their viscosity tends to be low, especially when the cationic component comprises a mixture of water-insoluble and water-soluble cationic materials. It will be appreciated that for consumer products of this type, it is important that the viscosity is kept within acceptable limits so that the user of the product can dispense the correct amount of product consistently. Because of the relative complexity of these systems, it is no easy matter to increase the viscosity of the compositions. Many conventional thickening agents are incompatible with the emulsified system or fail to give a stable viscosity.

The present invention is based on the recognition that certain aromatic carboxylic acids provide good viscosity control in such systems.

Although certain aromatic carboxylic acids have been mentioned as possible additives (e.g. as pH regulators or as antimicrobial agents) in some more conventional fabric softening compositions (see e.g. Belgiam Pat. No. 973,339, German Offenlegungsschrift No. 1,444,081 and No. 2,216,098), their use as thickening agents in such compositions has not been suggested heretofore.

There has also been a suggestion in two papers by L. S. C. Wan, in J. Pharm. Sci., 1966, 55, 1395 and J. Pharm. Sci., 1967, 56, 743 that salicylic acid (although specifically not benzoic acid) could act as a thickening agent for solutions of cationic surfactants. As indicated above, the presence of cationic softener materials in emulsified form presents very special problems and it is believed that the aromatic carboxylic acids used in the present invention interact in some way with the emulsified particles to give a viscosity increase.

According to the present invention, there is provided a textile treatment composition in the form of an aqueous emulsion and comprising:

(a) a water-insoluble cationic fabric softener;
(b) a water-insoluable nonionic fabric softener; and
(c) from 0.1% to 10% of an aromatic mono- or di-carboxylic acid.

Preferred compositions contain from 0.5% to 12% of each of components (a) and (b).

Preferably, the composition also includes from 0.5% to 12% of a water-soluable cationic surfactant. Preferred carboxylic acids are benzoic acid, salicylic acid and phthalic acid.

The essential components of the invention will now be described in more detail.

The water-insoluble cationic fabric softener can be any fabric-substantive cationic compound the acid salt form of which has a solubility in water of less than 10 g./1. Highly preferred materials are quaternary ammonium salts having two $C_{10}$-$C_{22}$ alkyl chains, optionally substituted or interrupted by functional groups such as—OH,—O—,—CONH—, etc.

Well-known species of substantially water-insoluble quaternary ammonium compounds have the formula

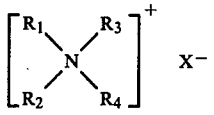

wherein $R_1$ and $R_2$ represent hydrocarbyl groups of from about 10 to about 22 carbon atoms; $R_3$ and $R_4$ represent hydrocarbyl groups containing from 1 to about 4 carbon atoms; X is an anion and preferably selected from halide, and methyl sulfate radicals. Representative examples of quaternary softeners include ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride and di(coconut alkyl) dimethyl ammonium chloride are preferred.

Another class of suitable cationic compatibilizing agents can be represented by $C_{8-25}$ alkylimidazolinium salts. Preferred salts are those conforming to the formula

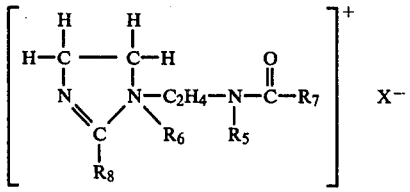

wherein $R_6$ is a $C_1$-$C_4$ alkyl radical, $R_5$ is hydrogen or a $C_1$-$C_4$ alkyl radical, $R_8$ is a $C_8$-$C_{25}$ alkyl radical and $R_7$ is hydrogen or a $C_8$-$C_{25}$ alkyl radical. X is a charge balancing ion which has the same meaning as X defined in the quaternary ammonium compatibilizing agent above.

The water-insoluble cationic material can be used at a level of from 0.5% to 12% in the composition, preferably from 1% to 5%, for example about 2.5%.

The water-insoluble nonionic fabric softener must have at least one $C_{12}$-C≧alkyl chain and can be selected from a wide range of organic nonionic compounds. Preferred materials are selected from:

(i) esters of fatty alcohols having from 12 to 24 carbon atoms in the alkyl chain and mono- or polycarboxylic acids having from 1 to 8 carbon atoms in the alkyl chain, whereby the total number of carbon atoms in the ester is equal to or greater than 16;

(ii) mono-ethers of fatty alcohols having from 10 to 24 carbon atoms in the alkyl chain and mono- or poly-alcohols having from 2 to 8 carbon atoms;

(iii) compounds of the formula $R_3$—X—$R_4$ wherein $R_3$ has from about 12 to 24 and $R_4$ has from 1 to about 6 carbon atoms in the alkyl chain which can be interrupted by not more than one oxygen link, and X stands for sulfur, —NHCO— or CONH; and (iv) $C_{10}$-$C_{24}$ fatty acid esters of mono- or polyhydric alcohols containing from 1 to 8 carbon atoms, or anhydrides thereof.

A preferred group of nonionic lubricants are the fatty acid esters of a mono- or polyhydric alcohol or anhydride thereof, said alcohol or anhydride having from 1 to 8 carbon atoms. It is preferred that the fatty acid ester has at least 1, more preferably at least 2, free (i.e., unesterified) hydroxyl groups.

The mono- or polyhydric alcohol portion of the ester can be represented by methanol, isobutanol, 2-ethylhexanol, isopropanol, ethylene glycol and polyethylene glycol with a maximum of 5 ethylene glycol units, glycerol, diglycerol, xylitol, sucrose, erythritol, pentaerythritol, sorbitol or sorbitan. Ethylene glycol, glycerol and sorbitan esters are particularly preferred.

The fatty acid portion of the ester normally comprises a fatty acid having from 12 to 22 carbon atoms, typical examples being lauric acid, myristic acid, palmitic acid, stearic acid and behenic acid.

One highly preferred group of softening agents for use in the present invention is the sorbitan esters, which are esterified dehydration products of sorbitol.

Sorbitan mono- and di-esters of lauric, myristic, palmitic, stearic and behenic (docosanoic) acids are particularly useful herein as softening agents and also can provide an anti-static benefit to fabrics. Mixed sorbitan esters, e.g. mixtures of the foregoing esters, and mixtures prepared by esterifying sorbitan with fatty acid mixtures such as the mixed tallow fatty acids, are useful herein and are economically attractive. Unsaturated $C_{10}$-$C_{22}$ sorbitan esters, e.g. sorbitan monooleate, usually are present in such mixtures in low concentration. The term "alkyl" as employed herein to describe the sorbitan esters encompasses both the saturated and unsaturated hydrocarbyl ester side chain groups.

For the purpose of the present invention, it is preferred that a significant amount of di- and tri-sorbitan esters are present in the ester mixture. Ester mixtures having from 20%–50% mono-ester, 25%–50% di-ester and 10%–35% of tri- and tetra-esters are preferred.

The material which is sold commercially as sorbitan mono-ester (e.g. mono-stearate) does in fact contain significant amounts of di- and tri-esters and a typical analysis of sorbitan monostearate indicates that it comprises ca. 27% mono-, 32% di- and 30% tri- and tetra esters. Commercial sorbitan mono-stearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters.

Other fatty acid partial esters useful in the present invention are xylitol monopalmitate, pentaerythritol mono-stearate, sucrose monostearate, glycerol monostearate and ethylene glycol monostearate. As with the sorbitan esters, commercially available mono-esters normally contain substantial quantities of di- or tri-esters.

The glycerol esters are also highly preferred. These are the mono-, di- or tri-esters of glycerol and fatty acids of the class described above. Commercial glyceryl mono-stearate, which may contain a proportion of the di- and tri-stearates, is especially preferred.

A second useful group of nonionic materials are the fatty alcohol esters derived from $C_{12}$-$C_{24}$ fatty alcohols. Examples of suitable fatty alcohols include: stearyl, oleyl, palmityl, lauryl, cocoyl, arachidyl and behenyl alcohol. The fatty alcohol is esterified with a mono- or polycarboxylic acid having from 1 to 8, preferably from 2 to 6 carbon atoms in the alkyl chain.

Examples of suitable monocarboxylic acids include: acetic, propionic, butyric, isobutyric, valeric, lactic, glycolic and $\beta,\beta'$ dihydroxy-isobutyric acid. Examples of suitable polycarboxylic acids include: n-butylmalonic, isocitric, citric, malic, maleic and succinic acid.

The total number of carbon atoms in the fatty alcohol esters is equal to or greater than 16.

Specific examples of fatty alcohol esters for use herein include: stearyl acetate, palmityl di-lactate, cocoyl isobutyrate, oleyl maleate, oleyl di-maleate and tallowyl propionate.

The fatty alcohol radical in the fatty alcohol mono-ethers can correspond to the fatty alcohol radicals in the ester component described above. Thus suitable fatty alcohols are all those of natural or synthetic origin listed above. The short chain mono- or polyalcohol can contain from 2 to 8 carbon atoms in the alkyl chain. Examples of suitable species include: ethylene glycol, glycerol, ethanol, isopropanol, vinyl alcohol, sorbitol and penta-erythritol.

Specific examples of fatty alcohol mono-ethers are represented by: batyl alcohol (stearyl glycerol mono-ether), behenyl ethylene glycol mono-ether, octadecyl vinyl ether, and cocoyl ethyleneglycol mono-ether.

The nonionic fabric softener can also be represented by a compound having the formula: $R_3$—X—$R_4$ wherein $R_3$ has from 12 to 24 carbon atoms and $R_4$ from 1 to about 6 carbon atoms in the alkyl chain which can be interrupted by not more than one oxygen link and X stands for sulfur-, $$-NH,-\overset{O}{\overset{\|}{C}}-,\ \text{and}\ -\underset{O}{\underset{\|}{C}}-NH-.$$

Suitable examples of this compound include: N-steryl methacrylamide, stearyl vinyl sulfide, N-palmityl 2-hydroxyethylamide, N-tallowyl 3-hydroxypropylamide, and N-2-hydroxypropyl arachidylamide.

The nonionic facric softener is conveniently used in an amount from 0.5% to about 12%, preferably from 1% to 8%, and most preferably from 2% to 6%. The ratio of insoluble cationic softener to nonionic softener is preferably from 3:1 to 1:3, especially from 1:1 to 1:2.

The aromatic carboxylic acid useful in the present invention can be any compound having an aromatic ring, preferably a benzene ring, and having one or two carboxylic acid groups, preferably attached directly to the benzene ring.

Preferred compounds have the general formula

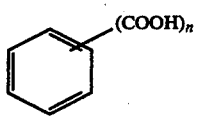

wherein n is 1 or 2 and wherein the benzene ring can also carry one or two other substituents. Preferred other substituents are of the electron-donating type and can be independently selected from hydroxyl, $C_1$—$C_4$ alkyl, $C_1$—$C_4$ alkoxy, amino and substituted amino groups, $O^{(-)}$,—$OC_6H_5$ and—NHCOR where R is $C_1$—$C_4$ alkyl.

Highly preferred compounds are benzoic acid and salicylic acid.

The aromatic carboxylic acid is used at a level sufficient to give the desired viscosity increase. Normally, levels of from 0.1% to 5%, especially from 0.2% to 1% are employed.

It should be understood that in appropriate cases, the necessary carboxylic acid can be added to the composition in the form of an anhydride. For example, phthalic anhydride may also be employed.

In addition to the above-discussed three essential components, highly preferred compositions according to the invention additionally include a water-soluble cationic surfactant.

By water-soluble, it is meant that the cationic surfactant has a solubility of greater than 10 g./1. Normally, such materials are ammonium salts having one $C_{12}$-$C_{24}$ alkyl chain, optionally substituted or interrupted by functional groups such as—0—,—COO—,—CONH—,—OH, etc.

The present invention is particularly applicable to systems including such water-soluble materials as they tend to have lower viscosities, for example in the range of 15–40 cp.

Although quaternized water-soluble materials are not excluded, highly preferred water-soluble cationics are the amine salts, especially the polyamine salts of the general formula:

$$R-\overset{R'}{\underset{R'}{N^{(+)}}}-\left[(CH_2)_n-\overset{R'}{\underset{R'}{N^{(+)}}}\right]_m-R',\ (m+1)A^{(-)}$$

wherein R, and optionally one of the R′ groups fixed on the same nitrogen atom as R, is an alkyl or alkenyl group having from 10 to 22 carbon atoms; the other R′ groups are independently selected from hydrogen, $(C_2H_4O)_pH$, $(C_3H_6O)_pH$ and $C_1$-$C_4$ alkyl provided that not all R′ groups are $C_1$-$C_4$ alkyl; p is a number totalling not more than 25 per molecule; m is from 1 to 8; n is from 2 to 6; and $A^{\ominus}$ is an anion.

One group of preferred cationic materials have the general formula $$R-\overset{R'}{\underset{H}{N^{\oplus}}}-\left[(CH_2)_n-\overset{R'}{\underset{H}{N^{\oplus}}}\right]_m-R',\ (m+1)A^{\ominus}$$

wherein R is $C_{10}$-$C_{22}$ alkyl, especially $C_{16}$-$C_{18}$ alkyl; R′ is hydrogen or $C_1$-$C_4$ alkyl; m is from 1 to 3; n is from 2 to 6; and A is an anion such as chloride, acetate or sulphate. In preferred materials of this class, R′ is hydrogen, m is 1 and n is 3. An example is the dihydrochloride of N-tallowylpropylenediamine. The diacetate salt of this compound is sold by Pierrefitte-Auby under the Trade Name DINORAMAC and by Armour-Hess under the Trade Name DUOMAC. The term "tallowyl" denotes the predominantly $C_{16}$-$C_{18}$ alkyl groups derived from tallow fatty acids.

Another, and highly preferred group of cationic amine salts is that of the general formula (I) in which at least one of the nitrogen atoms is substituted with ethoxylate or propoxylate groups. Preferably, both nitrogen atoms are so substituted and most preferably with ethoxylate groups. The total number of ethoxylate groups in the molecule may go as high as 25 although normally not more than 15, preferably up to 6, ethoxylate groups are present.

The preferred alkoxylated species have the general formula (II)

$$R-\overset{R_1}{\underset{R_2}{N^{\oplus}}}-\left[(CH_2)_n-\overset{R_1}{\underset{R_2}{N^{\oplus}}}\right]_m R_1,\ (m+1)A^{\ominus}$$

wherein R is a $C_{10}$-$C_{22}$ alkyl group; $R_1$ is $(C_2H_4O)_pH$ or $(C_3H_6O)_pH$ where the total p in the molecule is not more than 15; $R_2$ is hydrogen or $C_1$-$C_4$ alkyl; n is from 2 to 6; m is from 1 to 3 and A is an anion.

Specific ethoxylated materials suitable for use herein include:

N-tallowyl,N,N′,N′-tris(2-hydroxyethyl)1,3-propanediamine di-hydrochloride;

N-stearyl-N,N′-di(2-hydroxyethyl)-N′-(3-hydroxypropyl)-1,3-propanediamine dihydrofluoride;

N-oleyl N,N′,N′-tris(3-hydroxypropyl)-1,3-propanediamine dihydrofluoride;

N-stearyl N,N′,N′-tris(2-hydroxyethyl)N,N′-dimethyl-1,3-propanediammonium dimethylsulphate;

N-palmityl N,N',N'-tris(3-hydroxypropyl)-1,3-propanediamine dihydrobromide.

The soluble cationic surfactant comprises, in preferred compositions, from 0.5% to 12% of the composition. The preferred ratio of insoluble to soluble cationic material is from 5:1 to 1:3, preferably from 3:1 to 1:1.

In addition to the above-described components, the compositions may contain other textile treatment or conditioning agents. Such agents include silicones, as for example described in German Patent Application No. DOS26 31 419 incorporated herein by reference.

The optional silicone component can be used in an amount of from about 0.5% to about 6%. preferably from 1% to 4% of the softener composition. In other preferred executions of this invention, the weight ratio of the sum of nonionic fabric lubricant and silicone to total cationic surfactant is in the range from 2:1 to 1:3.

The compositions herein can contain other optional ingredients which are known to be suitable for use in textile softeners at usual levels for their known function. Such adjuvants include emulsifiers, perfumes, preservatives, germicides, viscosity modifiers, colorants, dyes, fungicides, stabilizers, brighteners, and opacifiers. These adjuvants, if used, are normally added at their conventional low levels (e.g., from about 0.1% to 5% by weight).

The compositions can normally be prepared by mixing the ingredients together in water, heating to a temperature of about 60° C. and agitating for 5—30 minutes.

It is highly preferred and generally provides better performance, first to mix the cationic either in neutralized or un-neutralized form in the molten nonionic fabric lubricant or mix both together in liquid form, and then disperse the mixture in the aqueous carrier medium (containing the necessary quantity of acid for the partial or total neutralization of the cationic) with good agitation. Depending upon the particular selection of nonionic and cationic softeners, it may be necessary in certain cases to include other emulsifying ingredients or to employ more efficient means for dispersing and emulsifying the particles (e.g., high speed blender).

Normally, at 60° C., the softening agents exist in liquid form and therefore form true emulsions with an aqueous continuous phase. On cooling, the disperse phase may wholly or partially solidify so that the final composition exists as a dispersion which is not a true liquid/liquid emulsion. It will be understood that the term "dispersion" means liquid/liquid phase or solid/-liquid phase dispersions and emulsions.

The pH of the compositions is generally adjusted to be in the range from about 3 to about 8, preferably from about 4 to about 6. In this preferred pH range, it will be understood that the neutralization of amines or polyamines in the composition is normally incomplete.

Normally, the carboxylic acid is used as at least part of the neutralizing medium for the amine salt, if present. Thus, the carboxylic acid can be used in an amount sufficient to bring the pH of the aqueous composition down to the desired range of about 4 to 6. In preferred compositions including a diamine salt, this means that sufficient acid is present to form a partial ammonium salt.

Compositions of the present invention normally contain from 3% up to about 20% of active ingredients and in this form they are suitable for use as rinse-added fabric softeners in convetional laundry operations.

When compositions of the present invention are added to the rinse liquor, a concentration from about 10 ppm to 1000 ppm, preferably from about 50 ppm to about 500 ppm, of total active ingredient is appropriate.

The following examples illustrate the invention.

EXAMPLE 1

N-tallowyl 1,3-propane diamine (10 g.), glycerine monostearate (30 g.) and ditallow dimethyl ammonium chloride (23 g.) were pre-mixed in the form of a melt at about 65° C., then added to a water seat at 60° C. containing about 4 g. of benzoic acid and agitated for 20 minutes. The dispersion was made up to 1000 ml., and contained 2.3% of ditallowdimethyl ammonium chloride (DTDMAC), 3% of glycerine monostearate (GMS), 1.0% of tallowylpropane diamine, and 0.4% of benzoic acid.

This composition had a viscosity of about 150 cp. The same composition without benzoic acid had a viscosity in the range from 20–30 cp.

EXAMPLE 2

Glycerine monostearate (35 g.) was melted at 65° C. and to the melt was added DTDMAC (30 g.) and stearyloxypropylaminopropylamine (20 g.). This mixture, together with salicylic acid (4 g.) was then dispersed by stirring into 1 liter of water to five a fabric softening composition in emulsion form having a viscosity of 120 cp.

EXAMPLE 3

Following the procedure of Example 2, a composition was prepared having 3% of DTDMAC, 3.5% of GMS, 1% of N-stearyl-N,N',N'-tri(2-hydroxyethyl)-1,3-propane diamine and 0.5% of salicylic acid.

The above composition has a viscosity in the range from about 150 to 200 cp.

All of the above compositions gave an excellent softening benefit on fabrics rinsed in a dilute solution of the compositions.

The following are further examples of the invention.

| Example No.: Ingredients | 4 % | 5 % | 6 % | 7 % | 8 % | 9 % | 10 % | 11 % |
|---|---|---|---|---|---|---|---|---|
| DTDMAC | 2.5 | — | 2 | 1 | — | 3 | 2 | 1 |
| Stearylbenzyl-dimethylammonium chloride | — | 2 | 6 | 6 | 4 | — | — | — |
| GMS | 3 | — | 3.5 | — | 2 | 4 | 2.5 | 3 |
| Sorbitan mono-stearate | — | 3.5 | — | 3 | — | — | — | — |
| N-stearylpropylene diamine | — | — | 4 | 1.5 | — | — | — | — |
| N-tallowyl N,N',N'-tris(2-hydroxyethyl) 1,3-propanediamine | 2 | 4 | — | — | 2 | — | — | — |
| N-stearyl N,N',N'-tris(2-hydroxyethyl) N,N'dimethyl-1,3-propanediammonium dimethylsulphate | — | — | — | — | — | 1.5 | — | 1.5 |
| Benzoic acid | 0.4 | — | — | — | — | 0.15 | 0.15 | 0.2 |
| Salicylic acid | — | 0.8 | — | — | — | — | — | — |
| Phthalic acid | — | — | 1 | — | — | — | — | — |
| Sodium p-hydroxy-benzoic acid | — | — | — | 0.2 | — | — | — | — |
| m-Toluic acid | — | — | — | — | 0.4 | — | 0.15 | — |

Useful compositions are also obtained when the DTDMAC in Examples 4, 6, 7, 9 and 10 is replaced by a ditallow imidazolinium softener such as Varisoft (Trade Mark).

What is claimed is:

1. A textile treatment composition in the form of an aqueous dispersion and comprising
   (a) a water-insoluble cationic fabric softener;
   (b) a water-insoluble nonionic fabric softener; and
   (c) from 0.1% to 10% of an aromatic mono- or di-carboxylic acid.

2. The composition of claim 1 wherein the cationic fabric softener is selected from (1) compounds of the general formula $R_1R_2R_3R_4N^{(+)}X^{(-)}$ wherein $R_1$ and $R_2$ are each selected from $C_{12}$-$C_{24}$ alkyl, $R_3$ and $R_4$ are each selected from $C_1$-$C_4$ alkyl and $X^{(-)}$ is an anion, (2) di $C_{12}$-$C_{24}$ alkyl imidazolinium salts and (3) mixtures thereof.

3. The composition of claim 1 wherein the nonionic fabric softener is selected from the group consisting of
   (i) esters of fatty alcohols having from 12 to 24 carbon atoms in the alkyl chain and mono- or polycarboxylic acids having from 1 to 8 carbon atoms in the alkyl chain, whereby the total number of carbon atoms in the ester is equal to or greater than 16;
   (ii) mono-ethers of fatty alcohols having from 10 to 24 carbon atoms in the alkyl chain and mono- or poly-alcohols having from 2 to 8 carbon atoms;
   (iii) compounds of the formula $R_3$—X—$R_4$ wherein $R_3$ has from about 12 to 24 and $R_4$ has from 1 to about 6 carbon atoms in the alkyl chain which can be interrupted by not more than one oxygen link, and X stands for sulfur—, —NHCO— or CONH; and
   (iv) fatty acid esters of mono- or poly-hydric alcohols containing from 1 to 8 carbon atoms, or anhydrides thereof.

4. The composition of claim 1 wherein the carboxylic acid has the general formula

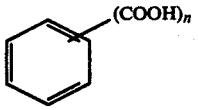

where n is 1 or 2 and wherein the benzene ring is optionally substituted with one or two other substituents independently selected from hydroxyl, alkoxyl $C_1$-$C_4$ alkyl, halogen, and amino groups.

5. A textile treatment composition in the form of an aqueous dispersion and comprising
   (a) from 0.5% to 12% of a water-insoluble cationic fabric softener selected from
      (1) compounds of the general formula $R_1R_2R_3R_4N^{(+)}X^{(-)}$ wherein $R_1$ and $R_2$ are each selected from $C_{12}$-$C_{24}$ alkyl, $R_3$ and $R_4$ are each selected from $C_1$-$C_4$ alkyl and $X^{(-)}$ is an anion,
      (2) di $C_{12}$-$C_{24}$ alkyl imidazolinium salts and
      (3) mixtures thereof;
   (b) from 0.5% to 12% of a water-insoluble nonionic fabric softener selected from the group consisting of
      (i) esters of fatty alcohols having from 12 to 24 carbon atoms in the alkyl chain and mono- or polycarboxylic acids having from 1 to 8 carbon atoms in the alkyl chain, whereby the total number of carbon atoms in the ester is equal to or greater than 16;
      (ii) mono-ethers of fatty alcohols having from 10 to 24 carbon atoms in the alkyl chain and mono- or poly-alcohols having from 2 to 8 carbon atoms;
      (iii) compounds of the formula $R_3$—X—$R_4$ wherein $R_3$ has from about 12 to 24 and $R_4$ has from 1 to about 6 carbon atoms in the alkyl chain which can be interrupted by not more than one oxygen link, and X stands for sulfur, —NHCO— or COHN; and
      (iv) fatty acid esters of mono- or poly-hydric alcohols containing from 1 to 8 carbon atoms, or anhydrides thereof; and
   (c) from 0.2% to 1% of a carboxylic acid having the general formula

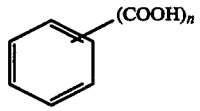

where n is 1 or 2 and wherein the benzene ring is optionally substituted with one or two other substituents independently selected from hydroxyl, alkoxyl $C_1$-$C_4$ alkyl, halogen, and amino groups.

6. The composition of claim 5 wherein the carboxylic acid is selected from benzoic acid, salicylic acid and phthalic acid.

7. The composition of claim 5 wherein the nonionic softener is a $C_{16}$-$C_{22}$ fatty acid ester of sorbitan or glycerol.

8. The composition of claim 5 additionally comprising from 0.5% to 12% of a water-soluble cotionic surfactant.

9. The composition of claim 8 wherein the water-soluble cationic surfactant is an amine salt of the general formula

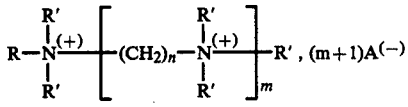

wherein R and optionally one of the R' groups fixed on the same nitrogen atom as R, is an alkyl or alkenyl group having from 10 to 22 carbon atoms; the other R' groups are independently selected from hydrogen, $(C_2H_4O)_pH$, $(C_3H_6O)_pH$ and $C_1$-$C_4$ alkyl provided that not all R' groups are $C_1$-$C_4$ alkyl; p is a number totalling not more than 25 per molecule; m is from 1 to 8; n is from 2 to 6; and $A^{(-)}$ is an anion.

* * * * *